US005913481A

United States Patent [19]

Matsuki et al.

[11] Patent Number: 5,913,481

[45] Date of Patent: Jun. 22, 1999

[54] SEPARABLE SLIDE FASTENER

[75] Inventors: Akira Matsuki; Mamoru Okada; Shigeyoshi Takasawa, all of Toyama, Japan

[73] Assignee: YKK Corporation, Tokyo, Japan

[21] Appl. No.: 08/979,785

[22] Filed: Nov. 26, 1997

[30] Foreign Application Priority Data

Nov. 29, 1996 [JP] Japan ..... 8-319651

[51] Int. Cl.[6] ..... A44B 19/00

[52] U.S. Cl. ..... 24/434; 24/433

[58] Field of Search ..... 24/434, 433, 435, 24/381

[56] References Cited

U.S. PATENT DOCUMENTS

| | | | |
|---|---|---|---|
| 2,549,051 | 4/1951 | Brown | 24/435 |
| 4,377,022 | 3/1983 | Akashi | 24/433 |
| 4,414,718 | 11/1983 | Kumano | 24/434 |
| 4,459,723 | 7/1984 | Takano et al. . | |
| 4,594,753 | 6/1986 | Yoshida et al. | 24/433 |
| 5,528,801 | 6/1996 | Hasegawa . | |

FOREIGN PATENT DOCUMENTS

| | | | |
|---|---|---|---|
| 4-125708 | 11/1992 | Japan . | |
| 7-79815 | 3/1995 | Japan . | |
| 0519342 | 3/1940 | United Kingdom | 24/435 |
| 2 098 270 | 11/1982 | United Kingdom . | |

*Primary Examiner*—Victor N. Sakran
*Attorney, Agent, or Firm*—Hill & Simpson

[57] ABSTRACT

In a separable slide fastener, a succession of discrete fastener elements molded on a pair of parallel connecting yarns at regular distances are folded individually in a U-shape about an inner edge of each of opposed fastener tapes and are attached by sewing threads. Several of the fastener elements are removed from a bottom end portion of each fastener tape by cutting the connecting yarns with corresponding part of the sewing threads remaining uncut as cores. Each of upper and lower legs of a lowermost one of said fastener elements is flatted to form a small-thickness portion. An insertion pin of a separable bottom stop assembly is attached to the bottom end portion of one fastener tape by clenching so as to hold the small-thickness portions and the cores, and a box pin is attached to the bottom end portion of the other fastener tape in the same manner.

8 Claims, 6 Drawing Sheets

SEPARABLE SLIDE FASTENER

BACKGROUND OF THE INVENTION

1. Field of the Invention

This invention relates to a separable slide fastener which comprises a pair of fastener tapes, a pair of fastener-element assemblies attached to confronting longitudinal edges of the fastener tapes by sewing, each fastener-element assembly having a succession of fastener elements molded on a pair of parallel connecting yarns at regular distances and folded individually into a U-shape about each of confronting longitudinal edges of the fastener tapes, and an insertion pin and a box pin attached to bottom end portions of the respective fastener tapes.

2. Description of the Related Art

Japanese Utility Model Laid-Open Publication No. Hei 4-125708 discloses a separable slide fastener which comprises a pair of fastener tapes, a pair of fastener-element assemblies attached to confronting longitudinal edges of the fastener tapes by sewing threads, and a separable bottom stop assembly attached to confronting bottom end portions of the fastener tapes. Each fastener-element assembly is composed of a succession of fastener elements extrusion-molded on a pair of parallel connecting yarns in such a manner that the connecting yarns are embedded in upper and lower legs, respectively, of the successive fastener elements. The individual fastener elements of each fastener-element assembly are folded in a U-shape about the inner longitudinal edge of the corresponding fastener tape. Each fastener tape has along its inner longitudinal edge a bulged portion to which the legs of the successive fastener elements are attached by the sewing threads. The bottom end portion of each fastener tape is formed by removing several fastener elements. An insertion pin of the bottom stop assembly is attached to the fastener-element-free bottom end portion of one fastener tape, and a box pin is attached to the fastener-element-free bottom end portion of the other fastener tape.

Japanese Patent Laid-Open Publication No. Hei 7-79815 discloses another separable slide fastener which comprises a pair of fastener tapes, a pair of fastener-element assemblies attached to confronting longitudinal edges of the fastener tapes by sewing threads, and a separable bottom stop assembly attached to confronting bottom end portions of the fastener tapes. Each fastener tape is woven so as to form along its inner longitudinal edge a bulged portion in the form of a woven tube in which a plurality of core yarns are inserted. Each fastener-element assembly is composed of a succession of thermoplastic resin fastener elements extrusion-molded on a pair of parallel connecting yarns and folded individually in a U-shape about the inner longitudinal edge of each fastener tape; upper and lower legs of the fastener element are sewn to the bulged portion so as to clamp the bulged portion between them. An insertion pin of the bottom stop assembly is attached to the bulged bottom end portion of one fastener tape contiguously to the lowermost fastener element, and a box pin is attached to the bulged bottom end portion of the other fastener tape contiguously to the lowermost fastener element.

In conventional extrusion-molded slide fasteners, since the insertion pin or the box pin of the separable bottom stop assembly is attached to the longitudinal edge of each fastener tape so as to merely cover the sewing threads after cutting the connecting yarns of the fastener-element assembly, stable attachment of the bottom stop assembly members is difficult to achieve so that these members might be removed of the fastener tapes.

A solution has been proposed by the first-named publication. According to this solution, in an attempt to attach the fastener elements to the bulged longitudinal edges of the fastener tapes stably, a pair of grooves are formed in the inner surfaces of the upper and lower legs of each fastener element, and the individual fastener elements are attached to the bulged longitudinal edges of the fastener tapes by sewing with the bulged portion fitted in the grooves of the legs. The bottom end portion of each fastener tape is formed by cutting the connecting yarns to remove several fastener elements, whereupon the insertion pin or the box pin is attached to the element-free bulged portion at the bottom end portion of each fastener tape. With this structure, however, a gap is created at the boundary of the lowermost fastener element and the insertion pin or box pin so that the coupled fastener element rows would tend to split from the boundary. Further, because of the bulged portion, it is difficult to thread the fastener-element assembly onto the fastener tape edge when sewing the fastener elements to the fastener tape, which is laborious and time-consuming.

According to another solution proposed by the second-named publication, the bulged portion of the fastener tape edge is modified in an attempt to facilitate sewing the fastener-element assembly to the fastener tape edge. However, because of the core yarns, it is difficult to smoothly thread the fastener-element assembly onto the fastener tape edge so that an improved rate of production cannot be achieved. Further, since the insertion pin or the box pin are attached to the bottom end portion of each fastener tape contiguously to the lowermost fastener element by molding, a gap is created at the boundary between the lowermost fastener element and the insertion pin or box pin so that the coupled fastener element rows would tend to split from the boundary.

SUMMARY OF THE INVENTION

A first object of this invention is to provide a separable slide fastener in which an insertion pin or a box pin is attached to a bottom end portion of each of opposed fastener tapes firmly in close contact with the lowermost fastener element so that the coupled fastener element rows can be prevented from splitting and also that sewing of fastener elements of a fastener-element assembly to each fastener tape can be facilitated, improving the rate of production and hence making the slide fastener commercially useful.

A second object of the invention is to provide a separable slide fastener in which an insertion pin and a box pin are attached to the bottom end portions of opposed fastener tapes in a unique manner so as to be firmly joined with the lowermost fastener element, preventing the coupled fastener element rows from splitting and hence making the slide fastener stable in operation.

A third object of the invention is to provide a separable slide fastener in which successive fastener elements have a unique shape so as to be sewn to each of opposed fastener tapes firmly with the lowermost fastener element sewn in a stabilized form, thus enabling stabilized attachment of the insertion pin and the box pin to the bottom end portions of opposed fastener tapes.

A fourth object of the invention is to provide a separable slide fastener in which, by specifying the substance of fastener tapes and sewing yarns, bottom end portions of opposed fastener tapes are molded in such a form that an insertion pin and a box pin can be attached to the fastener tapes firmly in a simple manner.

A fifth object of the invention is to provide a separable slide fastener in which, by specifying the substance of an insertion pin and a box pin, various kinds of insertion and box pins and advantageous attaching means can be used.

According to a first aspect of the invention, there is provided a separable slide fastener comprising a pair of fastener tapes, a pair of fastener-element assemblies, and a separable bottom stop assembly. The pair of fastener-element assemblies are attached to confronting inner edges of the fastener tapes by sewing threads and each of the fastener-element assemblies includes a pair of parallel connecting yarns and a succession of discrete fastener elements molded on the connecting yarns at regular distances. The fastener elements are folded individually in a U-shape about the corresponding inner edge of each fastener tape and several of the fastener elements are removed from a bottom end portion of each fastener tape by cutting the connecting yarns. At this time, corresponding part of the sewing threads remain uncut as cores and each of upper and lower legs of a lowermost one of the fastener elements are formed into a small-thickness portion by flattening. The separable bottom stop assembly has an insertion pin and a box pin. The insertion pin is attached to the bottom end portion of one of the fastener tapes so as to hold the small-thickness portions and the cores. The box pin is attached to the bottom end portion of the other fastener tape so as to hold the small-thickness portions and the cores.

According to a second aspect of the invention, the fastener elements are molded of thermoplastic resin and the small-thickness portions are formed by flattening the lowermost fastener element of each fastener tape except a coupling head.

According to a third aspect of the invention, further, the coupling head of the lowermost fastener element of each fastener tape is cut off.

According to a fourth aspect of the invention, outer ends of the upper and lower legs of the lowermost fastener element of each fastener tape are also cut off.

According to a fifth aspect of the invention, each of the upper and lower legs of each fastener element has in its surface a transverse groove and in its opposite side surfaces a pair of side recesses communicating with the transverse groove. The sewing threads are received in the transverse groove and the side recesses.

According to a sixth aspect of the invention, the fastener tapes and the sewing threads comprise at least thermoplastic synthetic fibers. The sewing threads held by the insertion pin and the box pin are fused as the core.

According to a seventh aspect of the invention, the insertion pin and the box pin are made of metal and are fixedly attached to the respective fastener tapes by clenching.

According to an eighth aspect of the invention, the insertion pin and the box pin are formed of thermoplastic resin by injection molding.

DETAILED DESCRIPTION OF THE PREFERRED EMBODIMENTS

Preferred embodiments of a separable slide fastener according to this invention will now be described in detail with reference to the accompanying drawings.

Figure 1:
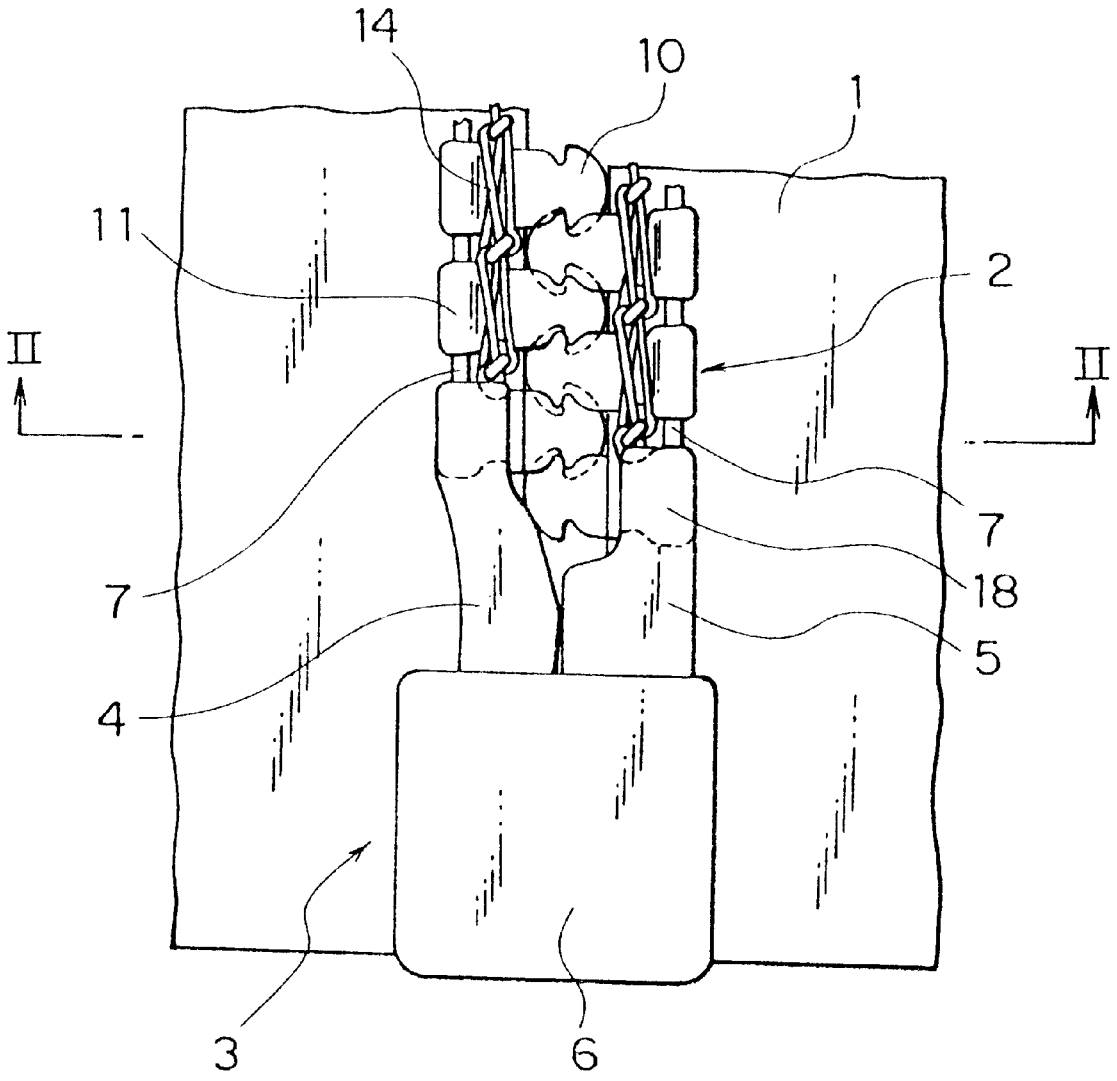
FIG. 1 is a fragmentary plan view of a separable slide fastener according to this invention.

As shown in FIG. 1, the separable slide fastener of this invention comprises a pair of fastener tapes 1, a pair of rows of fastener elements 2 attached to confronting longitudinal edges of the respective fastener tapes 1, and a bottom stop assembly 3 attached to confronting bottom end portions of the fastener tapes 1. The bottom stop assembly 3 is composed of an insertion pin 4 mounted on the bottom end portion of one fastener tape 1, a box pin 5 mounted on the bottom end portion of the other fastener tape 1, and a box 6 mounted on the box pin 5.

Figure 3:
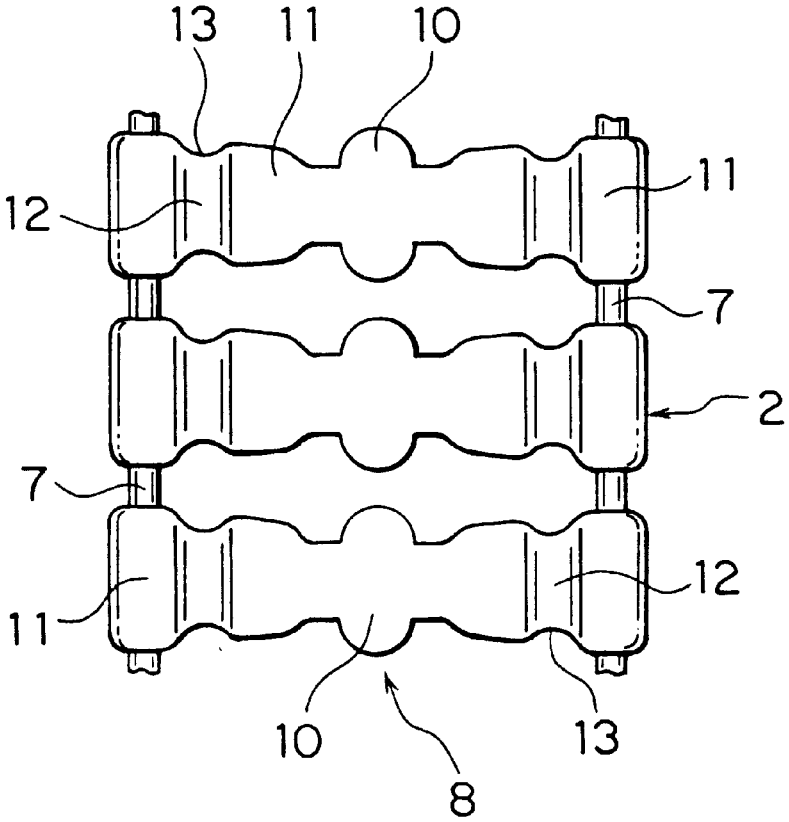
FIG. 3 is a fragmentary plan view of a fastener-element assembly of the separable slide fasterner.

As shown in FIG. 3, the successive fastener elements 2 are molded at regular distances on a pair of parallel connecting yarns 7 by extrusion using thermoplastic resin, such as polyamide, polyacetal and polypropylene, to form a flat fastener-element assembly 8. Each fastener element 2 has a coupling head 10 and a pair of legs 11 projecting from the coupling head 10 in opposite directions. The two connecting yarns 7 are embedded in the respective legs 11 on the side toward their outer ends. Each leg 11 has on its surface a transverse groove 12 by the connecting yarn 7 on the side toward the coupling head 10, and in its opposite side surfaces a pair of recesses 13 communication with opposite ends of the transverse groove 12.

Figure 4:
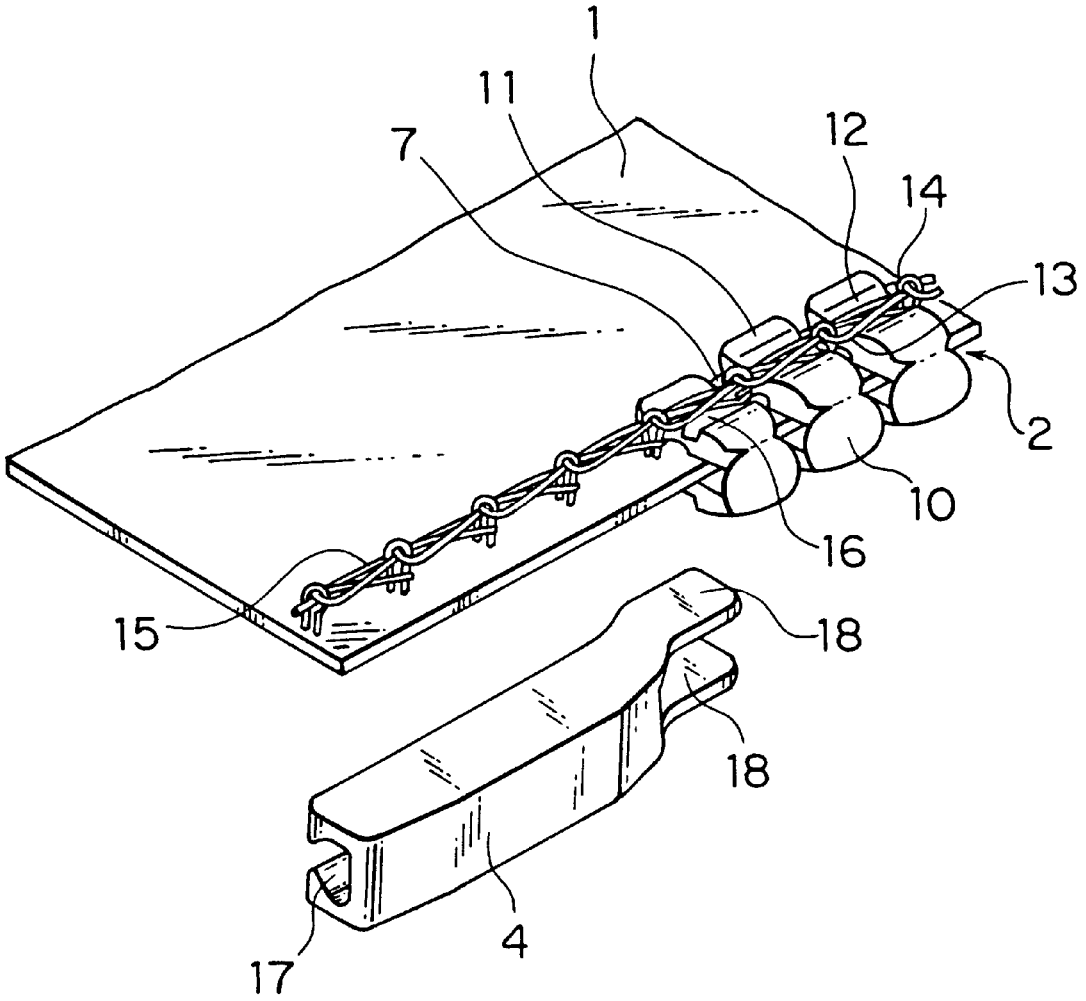
FIG. 4 is an exploded perspective view showing a bottom end portion of one fastener stringer and a metallic insertion pin of a separable bottom stop assembly.

As shown in FIG. 4, the flat successive fastener elements 2 of fastener-element assembly 8 are folded individually in a U-shape about the coupling head 10 and threaded onto the inner longitudinal edge of each of the fastener tape 1 and attached to the fastener tape 1 by sewing threads 14 received in the transverse grooves 12 and the recesses 13 of the upper and lower legs 11. Each fastener tape 1 is knitted or woven of thermoplastic synthetic fiber yarns, such as polyamide and polyester, or mixed fiber yarns, which are composed of synthetic fibers and natural fibers. The sewing threads 14 also comprise synthetic fiber yarns or mixed fiber yarns, which are composed of synthetic fibers and natural fibers. It is preferable that the connecting yarns 7 also comprise the same kind of synthetic fiber yarns.

A continuous length of opposed fastener stringers made of the fastener tapes 1 and the fastener-element assemblies 8 is severed into a predetermined length, and several fastener elements 2 are removed from the sewing threads 14 at the bottom end portion of each fastener stringer by cutting the connecting yarns 7 and also cutting the coupling heads 10 of the individual fastener elements 2. The element-free sewing threads 14 are fused with the fastener tape 1 by ultrasonic welding or other means to form cores 15. The insertion pin 4 or the box pin 5 is attached to the cores 15, during which each of the upper and lower legs 11 of the lowermost fastener element 2 is flatted by ultrasonic processing or other means to form a small-thickness portion 16 with or without cutting the coupling head 10.

Figure 2:
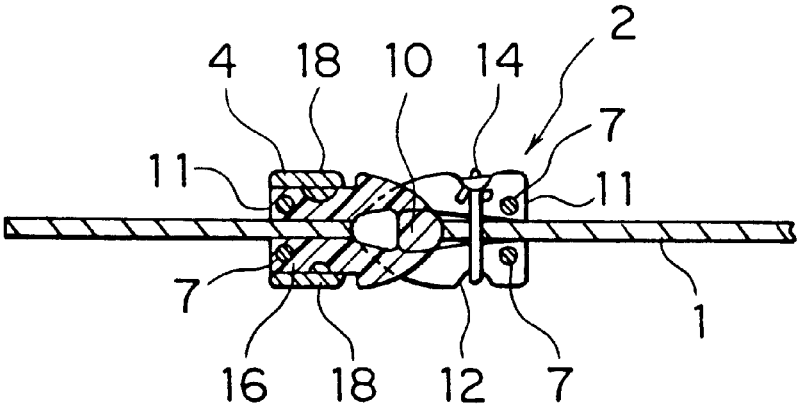
FIG. 2 is a transverse cross-sectional view taken along line II—II of FIG. 1.

As shown in FIG. 2, the small-thickness portion 16 has a thickness such that, when the insertion pin 4 or the box pin 5 is mounted on the upper and lower small-thickness portions 16, the thickness of the insertion pin 4 or the box pin 5 is equal to that of the coupling head 10 of the lowermost fastener element 2 or that of the next fastener element 2 so that a slider threaded on the opposed fastener stringers are free to slide over the insertion pin 4 and the box pin 5 for separating the slide fastener.

Each of the insertion pin 4 and the box pin 5 is attached to the bottom end portion of the corresponding fastener tape 1 so as to hold the cores 15 (see FIG. 4) and the upper and lower small-thickness portions 16 of the lowermost fastener element 2, as shown in FIG. 2. For example, the insertion pin 4, as shown in FIG. 4, is in the form of a metallic elongated box having in one side a key hole 17, in which the cores 15 formed on the bottom end portion of each fastener tape 1 is inserted, and at one end slightly sloping upper and lower tongues 18 for holding the upper and lower small-thickness portions 16. The box pin 5 also is in the form of a metallic elongated box shorter than the insertion pin 4 as shown in FIG. 1, and having vertical flat outer surfaces and, at its one end, upper and lower tongues 18 holding the upper and lower small-thickness portions 16. The other end of the box pin 5 is inserted into and fixed to the box 6.

Figure 5:
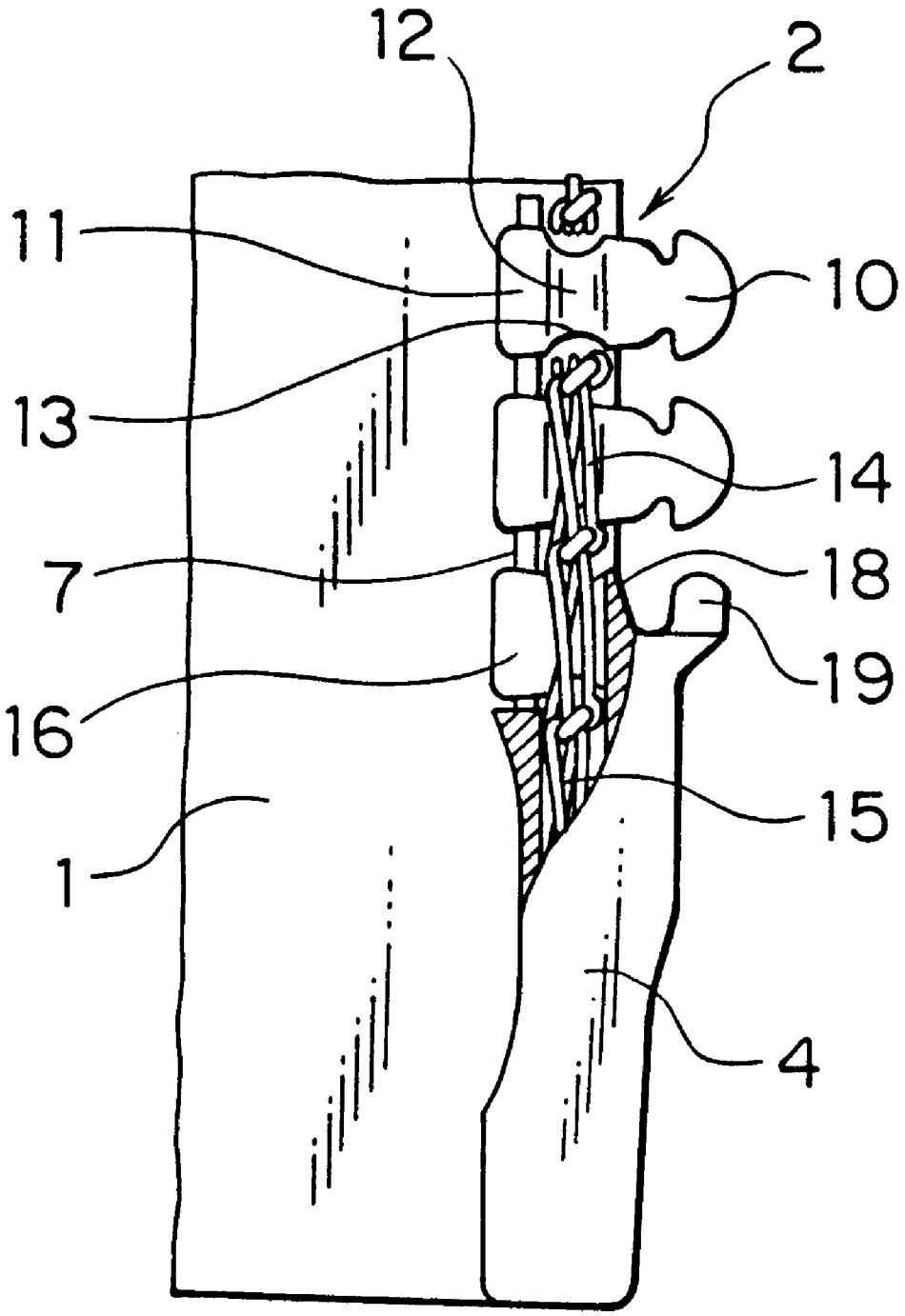
FIG. 5 is a plan view, with parts broken away, of the bottom end portion of one fastener tape with a modified metallic insertion pin attached to the bottom end portion.

The insertion pin 4 and the box pin 5 described in the above are formed of zinc alloy or aluminum alloy by die casting. As shown in FIG. 5, the coupling head 10 of the lowermost fastener element 2 may be cut off with the legs 11 remaining uncut but flatted into upper and lower small-thickness portions 16 and the insertion pin 4 maybe closed at the outer side opening between the two tongues 18 and may have an engaging projection 19 integrally extending from its upper end for engagement with the lowermost fastener element 2 of the companion fastener stringer. Alternatively, the box pin 5 and the box 6 may be molded simultaneously and integrally. The insertion pin 4 and box pin 5 are threaded onto the cores 15 of the respective bottom end portions of the opposed fastener tapes 1 and, at the same time, onto the upper and lower small-thickness portions 16, whereupon the upper and lower walls of the insertion pin 4 is clenched against the lowermost fastener element 2 and the cores 15 to hold them as a unit. As a result, the insertion pin 4 is fixedly attached to the bottom end portion of one fastener stringer. The box pin 5 also is attached to the bottom end portion of the other fastener stringer in same manner as the insertion pin 4.

Figure 6:
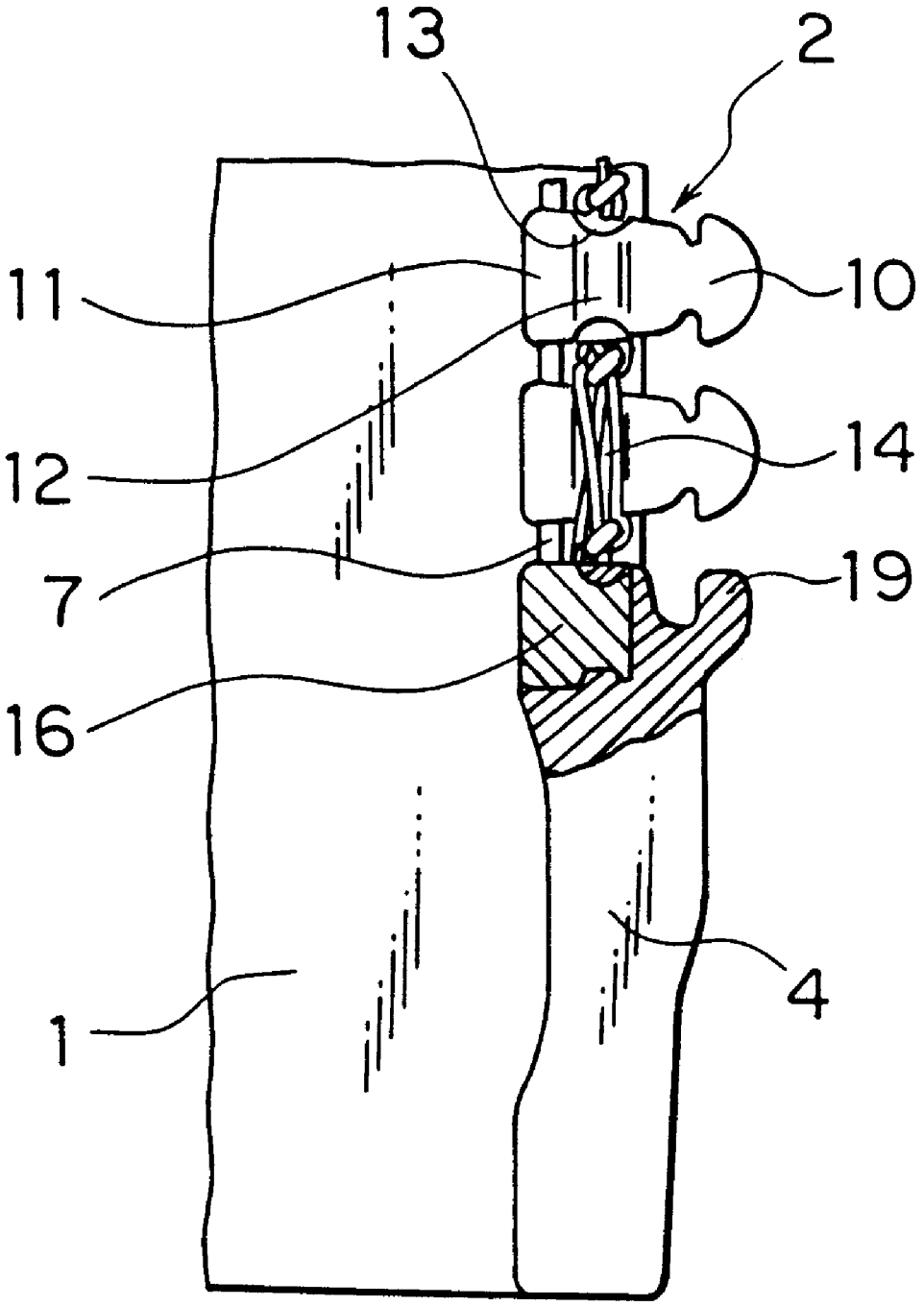
FIG. 6 is a plan view, with parts broken away, of the bottom end portion of one fastener tape with a thermoplastic resin insertion pin attached to the bottom end portion.

In the case shown in FIG. 6, the insertion pin 4 and the box pin 5 are made of thermoplastic resin, such as polyamide, polyacetal and polypropylene. The coupling head 10 of the lowermost fastener element 2 is cut off with the upper and lower legs 11 uncut but flatted into upper and lower small-thickness portions 16, and the insertion pin 4 is formed on the bottom end portion of one fastener stringer by injection-molding thermoplastic resin so as to hold the upper and lower small-thickness portions 16 of the lowermost fastener element 2 and the cores 15 (see FIG. 4) integrally.

Figure 7:
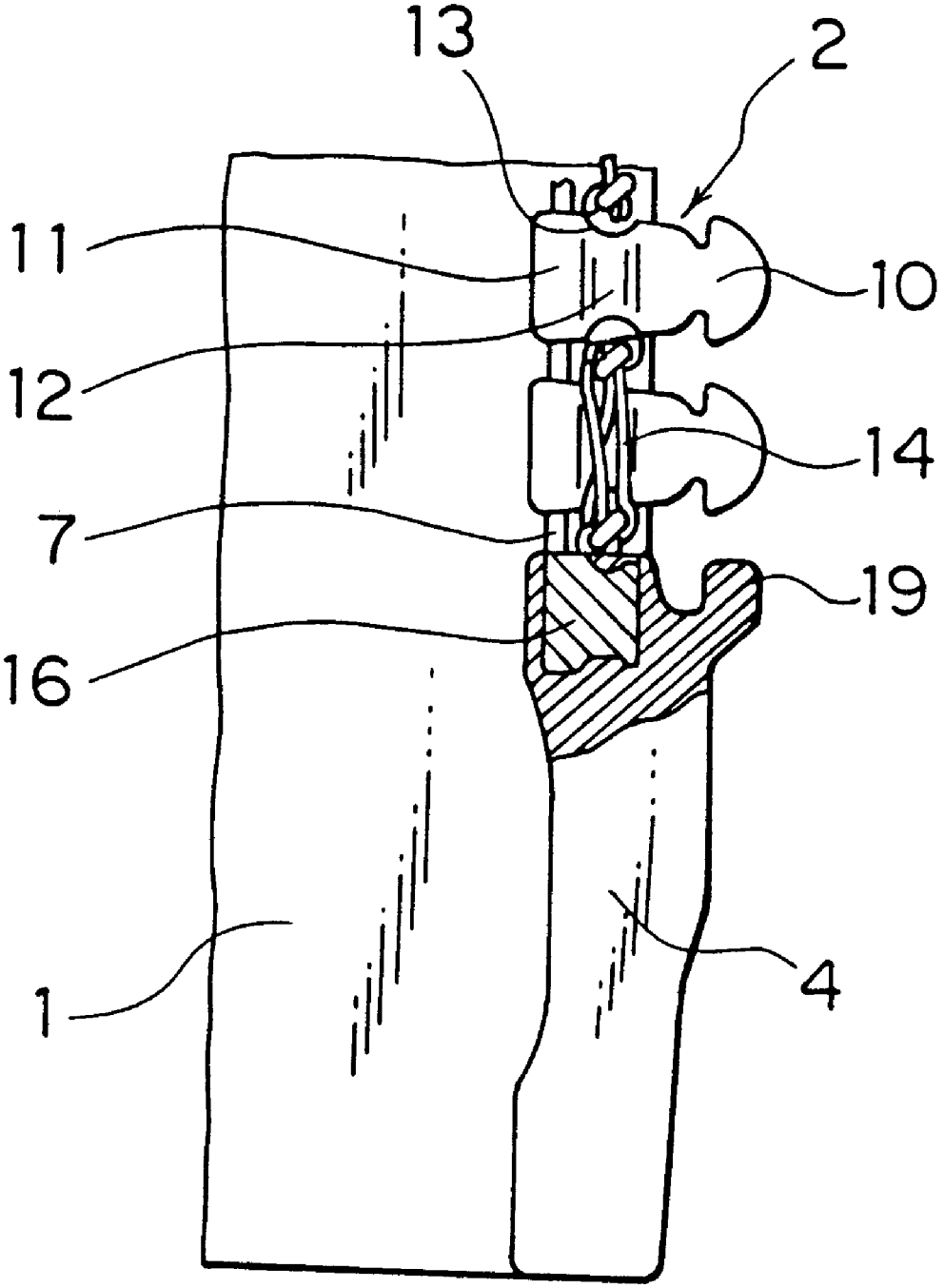
FIG. 7 is a plan view, with parts broken away, of the bottom end portion of one fastener tape with a modified thermoplastic resin insertion pin attached to the bottom end portion.

FIG. 7 shows an alternative form in which the coupling head 10 of the lowermost fastener element 2 and the outer ends of the upper and lower legs 11 are cut off, and the remaining upper and lower legs 11 are flatted into upper and lower small-thickness portions 16 by ultrasonic processing, whereupon the insertion pin 4 is formed on the bottom end portion of one fastener stringer so as to completely cover the upper and lower small-thickness thickness portions 16 by injection-molding thermoplastic resin. The box pin 5 also is formed on the bottom end portion of the other fastener stringer in the same manner as the insertion pin 4. Thus a tough separable bottom stop assembly 3 is formed.

With the separable slide fastener of this invention, following advantageous results can be obtained.

According to the first aspect of the invention, a separable slide fastener comprises: a pair of fastener tapes 1; a pair of fastener-element assemblies 8 attached to confronting inner edges of the fastener tapes 1 by sewing threads 14, each of the fastener-element assemblies 8 including a pair of parallel connecting yarns 7 and a succession of discrete fastener elements 2 molded on the connecting yarns 7 at regular distances and folded individually in a U-shape about the corresponding inner edge of the fastener tape 1, several of the fastener elements 2 being removed from a bottom end portion of the fastener tape 1 by cutting the connecting yarns 7 with corresponding part of the sewing threads 14 remaining uncut as cores 15, each of upper and lower legs 11 of a lowermost one of the fastener elements 2 being formed into a small-thickness portion 16 by flattening; and a separable bottom stop assembly 3 having an insertion pin 4 attached to the bottom end portion of one of the fastener tapes 1 so as to hold the small-thickness portions 16 and the cores 15, a box pin 5 attached to the bottom end portion of the other fastener tape 1 so as to hold the small-thickness portions 16 and the cores 15. With this structure, it is possible to secure the insertion pin 4 or the box pin 5 to the lowermost fastener element 2 with no gap between them so that the coupled fastener element rows can be prevented from splitting, which would have caused with the conventional separable slide fastener. Further, it is possible to sew the fastener-element assemblies 8 to the respective fastener tapes 1 without difficulty, thus improving the rate of production.

According to the second aspect of the invention, partly since the upper and lower legs 11 of the lowermost fastener element 2 of thermoplastic resin are flatted into upper and lower small-thickness portions 16, and partly since the insertion pin 4 or the box pin 5 is attached to the upper and lower small-thickness portions 16, it is possible to join the insertion pin 4 or the box pin 5 with the lowermost fastener element 2 firmly so that a split-free tough separable slide fastener can be achieved.

According to the third aspect of the invention, partly since the coupling head 10 of the lowermost fastener element 2 of thermoplastic resin is cut off with the upper and lower legs remaining uncut and flatted into upper and lower small-thickness portions 16, and partly since the insertion pin 4 or the box pin 5 is attached to the lowermost fastener element 2 so as to cover the majority of the upper and lower small-thickness portions 16, is possible to secure the insertion pin 4 or the box pin 5 to the lowermost fastener element 2 reliably and firmly, thus realizing a split-free tough separable slide fastener.

According to the fourth aspect of the invention, partly since the coupling head of the lowermost fastener element 2 of thermoplastic resin and the outer ends of the upper and lower legs 11 are cut off while the remaining upper and lower legs 11 are flatted into upper and lower small-thickness portions 16, and partly since the insertion pin 4 or the box pin 5 are attached to the lowermost fastener element 2 so as to cover the upper and lower small-thickness portions 16 completely, it is possible to secure the insertion pin 4 or the box pin 5 to the lowermost fastener element 2 accurately and firmly, thus achieving a split-free tough separable slide fastener.

According to the fifth aspect of the invention, partly since each of upper and lower legs 11 of the individual fastener element 2 of thermoplastic resin has in its outer surface a transverse groove 12 and in opposite side surfaces a pair of side recesses 13 communicating with opposite ends of the transverse groove 12, and partly since the sewing threads 14 are received in the transverse groove 12 and the side recesses 13, it is possible to sew the fastener elements 2 to the confronting longitudinal edges of opposed fastener tapes 1 very simply in a stabilized posture, thus realizing firm attachment of the insertion pin or the box pin.

According to the sixth aspect of the invention, partly since the fastener tapes 1 and the sewing threads 14 comprise at least thermoplastic synthetic fibers, and partly since the sewing threads 14 at the bottom end portion of each fastener tapes 1 and the fastener tape 1 are fused by ultrasonic welding or some other means as cores 15, it is possible to attach the insertion pin 4 or the box pin 5 to the bottom end portion of each fastener tape 1 firmly so as not to be accidentally removed, thus achieving a tough separable slide fastener.

According to the seventh aspect of the invention, since the insertion pin 4 and the box pin 5 are made of metal and attached to the confronting bottom end portions of opposed fastener tapes 1 by clenching, it is possible to attach the insertion pin 4 or the box pin 5 to each fastener tape 1 firmly by simple processing means. Thus a separable slide fastener having a metallic separable bottom stop assembly can be manufactured in a simple manner.

According to the eighth aspect of the invention, since the insertion pin 4 and the box pin 5 are formed by injection-molding thermoplastic resin, it is possible to attach the insertion pin 4 or the box pin 5 to the bottom end portion of each fastener tapes 1 firmly by simple processing means. Thus a separable slide fastener having a thermoplastic resin separable bottom stop assembly can be manufactured in a simple manner.

What is claimed is:

1. A separable slide fastener comprising:

(a) a pair of fastener tapes;

(b) a pair of fastener-element assemblies attached to confronting inner edges of said fastener tapes by sewing threads, each of said fastener-element assemblies including a pair of parallel connecting yarns and a succession of discrete fastener elements molded on said connecting yarns at regular distances and folded individually in a U-shape about the corresponding inner edge of each said fastener tape to form legs of the U-shape on opposite sides of each said fastener tape, several of said fastener elements being removed from a bottom end portion of each said fastener tape by cutting said connecting yarns with corresponding part of said sewing threads remaining uncut as cores, each of upper and lower legs of a lowermost one of said fastener elements being formed into a small-thickness portion by flattening; and (c) a separable bottom stop assembly having an insertion pin attached to said bottom end portion of one of said fastener tapes so as to hold said small- thickness portions and said cores, a box pin attached to said bottom end portion of the other fastener tape so as to hold said small-thickness portions and said cores.

2. A separable slide fastener according to claim 1, wherein said fastener elements are molded of thermoplastic resin, said small-thickness portions are formed by flattening said lowermost fastener element of each said fastener tape except a coupling head.

3. A separable slide fastener according to claim 2, wherein said coupling head of said lowermost fastener element of each said fastener tape is cut off.

4. A separable slide fastener according to claim 3, wherein outer ends of said upper and lower legs of said lowermost fastener element of each said fastener tape are cut off.

5. A separable slide fastener according to claim 1, wherein each of said upper and lower legs of each said fastener element has in its surface a transverse groove and in its opposite side surfaces a pair of side recesses communicating with said transverse groove, and said sewing threads extends in and through said transverse groove and said side recesses.

6. A separable slide fastener according to claim 1, wherein said fastener tapes and said sewing threads comprise at least thermoplastic synthetic fibers, and said sewing threads held by said insertion pin and said box pin are fused as said core.

7. A separable slide fastener according to claim 1, wherein said insertion pin and said box pin are made of metal and are fixedly attached to the respective fastener tapes by clenching.

8. A separable slide fastener according to claim 1, wherein said insertion pin and said box pin are formed of thermoplastic resin by injection molding.

* * * * *